United States Patent [19]

Vigneau

[11] 4,435,154

[45] Mar. 6, 1984

[54] HEAT TRANSFER DEVICE

[76] Inventor: David L. Vigneau, 12 Payan St., West Warwick, R.I. 02893

[21] Appl. No.: 399,293

[22] Filed: Jul. 19, 1982

[51] Int. Cl.[3] ..... F23D 13/12

[52] U.S. Cl. ..... 431/328

[58] Field of Search ..... 431/328, 329

[56] References Cited

U.S. PATENT DOCUMENTS

| | | | |
|---|---|---|---|
| 3,008,513 | 11/1961 | Holden | 431/328 |
| 4,035,132 | 7/1977 | Smith | 431/328 |
| 4,189,297 | 2/1980 | Bratko et al. | 431/328 |
| 4,255,123 | 3/1981 | Bishilany et al. | 431/328 |

*Primary Examiner*—Carroll B. Dority, Jr.
*Attorney, Agent, or Firm*—Barlow & Barlow

[57] ABSTRACT

There is disclosed a heat transfer device which combines controllable, infrared electromagnetic energy transfer with controllable, convective energy transfer and as desired, mass transfer of water or solvent vapors and which includes the use of a porous refractory board matrix which is secured to a single-chamber gas/air mixture plenum by means of compression fitted pins and through which the gas/air mixture passes and is combusted at and/or within the outer surface, said combustion producing both radiant heat source and hot gas heat source, and the use of incrementally attached air knife subassemblies which supply non-combustible gas flow outwardly in a controllable manner which both constricts the combustion to the surface of the matrix and reduces the temperature of the gaseous products of combustion and, as desired, permits the resultant mixed gas flow to be impinged upon target(s) to be heated or to be exhausted.

4 Claims, 5 Drawing Figures

HEAT TRANSFER DEVICE

BACKGROUND OF THE INVENTION

The present invention uniquely combines radiant infrared and convective heat transfer functions in a single device.

The general method of transferring energy by radiant means relates to the type of heaters or burners disclosed in U.S. Pat. Nos. 3,824,064; 4,189,297; 4,255,123; 4,272,237; and 4,290,746. Those burners were all designed to combust a gas/air mixture by blowing it through a porous, fibrous, refractory matrix and combusting it at or slightly within the outer surface of the matrix. The resultant combustion in the presence of large numbers of tiny refractory fibers converts a relatively large proportion of the heat of combustion to electromagnetic energy, much of which radiates outwardly toward the target(s) to be heated. Typically, the temperature achieved at the burning face of the matrix is between 1,150° F. and 1,650° F.

The above technology is well known, and such gas-fired, matrix-type heaters are able to achieve "conversion-to-radiation" efficiencies of 40% to 60%. Various patented and non-patented techniques are used to secure the refractory matrix to or within the gas/air mixture plenum and to constrict or otherwise control the combustion occurring at the outer face of the matrix. None of the known gas-fired, matrix-type heaters have been designed to utilize the 40% to 60% of the total combustion hat value which is contained in the gaseous products of combustion, in the immediate heat process zone or area. Rather, that heat is typically permitted to escape from the immediate process area in controlled, or sometimes uncontrolled fashion as exhaust.

In certain instances, the gaseous products of combustion from the above type of heaters may be exhausted after being drawn through a target web which is of sufficient porosity and in a moisture level condition or of a composition which permits such draw-through without damaging the web. These instances are exceptions rather than being commonplace, and the combustion product gases are not purposely controlled prior to contact with the web or other target(s) to be heated. In fact, flow-through heating of porous webs is not a recent technological development and has been used in various process systems for more than 30 years.

Although the gas-fired, matrix-type heater represented a significant advance in radiant heat transfer technology, those heating or burner devices have not, by themselves, been designed to effect both radiant and convective heat transfer nor have they been designed to provide mass transfer of water or solvent vapors from targets in those process applications in which the objective is the removal of liquids from the target. To accomplish these functions has in the past required that these burners or heaters be used in combination with other, sometimes patented devices such as air foils and exhaust assemblies.

SUMMARY OF THE INVENTION

In the present invention, a gas-fired, matrix-type burner is used to provide the heat source for both radiant and hot gas (i.e., convective) energy. The matrix itself is uniquely secured to a single-chamber gas/air mixture plenum by means of compression-fitted pins. Incrementally attached and independently operated air knives serve to support the matrix assembly, and, as appropriate, associated control instrumentalities, to constrict the combusting gas/air mixture to the face of the matrix, and to provide a controlled flow of non-combustible gases in a manner which permits a mixture of non-combustible gases and the hot gaseous products of combustion to be directed outwardly and, as desired, impinged upon the target(s) to be heated in a uniform manner and further, in certain applications to effect mass transfer of water or solvent vapors.

The method of construction of the present invention allows both the volume and velocity of non-combustible gases being expelled from the air knife openings to be adjusted to best suit the heating requirement being addressed. In the specific case in which solvents are being vaporized in the process (i.e., heat transfer ) area, the air knives can be adjusted to emit a volume of air which, when combined with the solvent vapors being emitted from the target(s), results in a solvent/air mixture ratio which is equal to or less than 25% of the lower explosive limit (LEL) of the mixture for that particular solvent.

The object of the present invention is to provide an integrated heater or burner assembly which both utilizes the relatively high radiant efficiency of the gas-fired, matrix-type heater and provides for a controlled flow of heated gases toward or onto the target in a manner which uniformly provides both convective transfer of heat and, as appropriate, the mass transfer of water, solvent or other vapors away from the target(s) in order to significantly increase total system heat transfer efficiency in the immediate process area or space heating area in which the invention is operated.

The use of incremental air knives on each edge of the matrix (and, therefore, each edge of the plenum) permits a high degree of flexibility in the manner in which the mixture of non-combustible gases and the gaseous products of combustion are uniformly directed away from the firing surface of the matrix and toward or onto the target(s). The flow of these mixed gases can be controlled with respect to velocity, volume, temperature and mixture ratio. Further, the volume and velocity of non-combustible gas emitted from each air knife subassembly can be independently controlled in order to achieve uniformity (or, in certain cases, non-uniformity) of outward gas flow to best meet the particular heating requirement being addressed.

The construction design of the present invention, including the manner in which the plenum is secured to the assembly frame, facilitates both installation and removal of the heat source (i.e., the combination of matrix and plenum) and simplifies the field serviceability of the invention. Simplicity of design also permits the invention to be manufactured at an economical cost level which can extend its applicability and use beyond the present market boundaries of prior art devices.

DESCRIPTION OF THE PREFERRED EMBODIMENT

Figure 1:
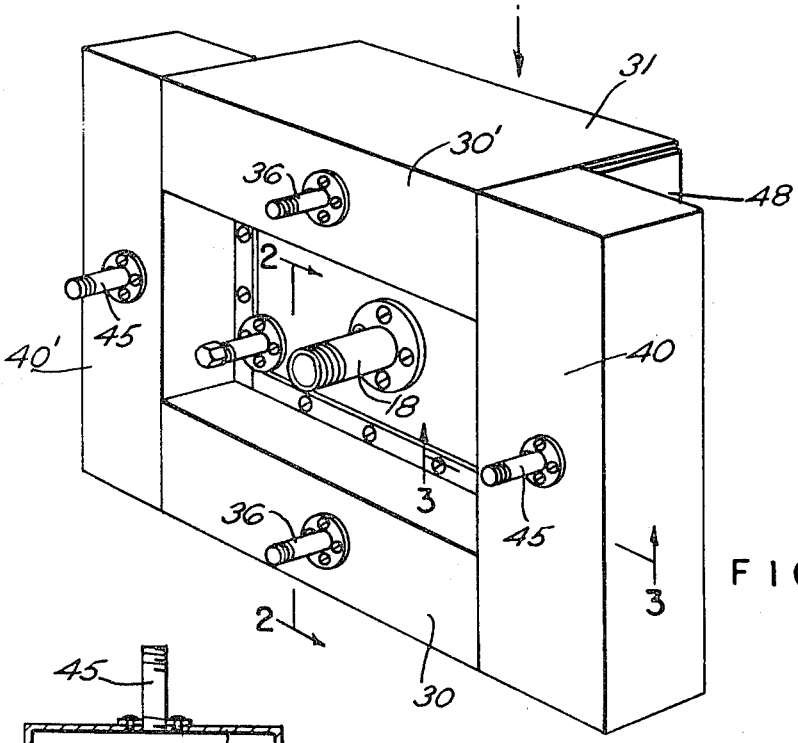
FIG. 1 is a perspective view of the heat transfer device of the invention taken from the backside thereof opposite the matrix.
Figure 3:
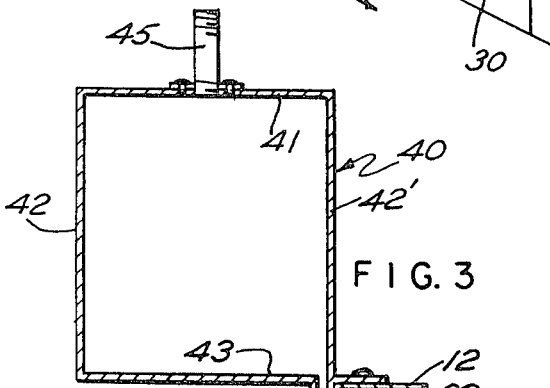
FIG. 3 is a sectional view taken on lines 3—3 of FIG. 1.
Figure 2:
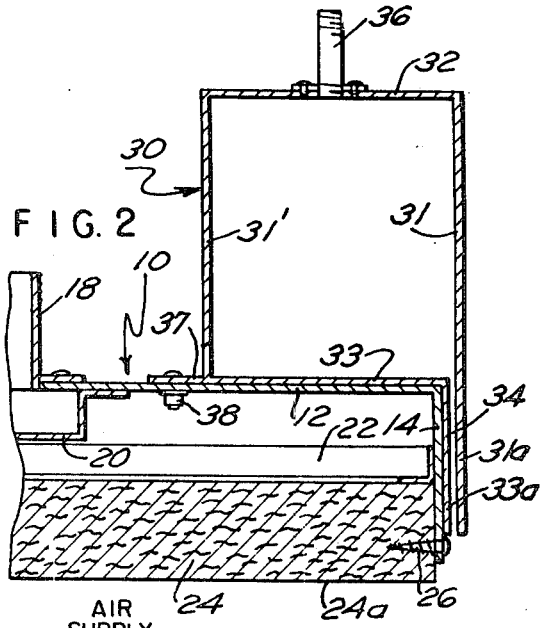
FIG. 2 is a sectional view of the device taken on lines 2—2 of FIG. 1.

Referring now to the drawing, the heat transfer device with the present invention, which is sometimes known as a burner, comprises essentially a rectangular gas/air plenum 10, which has a top wall 12, side walls 14 and edge walls 16. Through the top wall 12 is a gas/air mixture inlet pipe 18, that leads into a baffle 20, so that the gas/air mixture will be evenly distributed within the plenum chamber by means known to those skilled in the art. Extending about the side and end walls is a support angle 22 forming an abutment means. The support angle 22 provides an inner rest point for a matrix 24, which is desirably of a fibrous refractory, relatively dense, structurally self-supporting, felt-like material that is supplied in mat form. The matrix in the instant situation is fastened snugly against the support angle 22, by means of retention pins 26 that pass through the side and end walls 14 and 16, respectively, of the gas/air plenum 10, and as is seen in FIGS. 2 and 3 extends slightly below the lower edge of the side and end walls of the plenum. It is important that there be no gas emitted from the edge of matrix and to this end, the edges of the matrix are preferably coated with a refractory material that is impervious to gas so that the gas/air mixture that enters through the inlet pipe 18 will pass directly through the matrix and to the outer burning face 24*a* thereof. The matrix, therefore, is simply held and positioned against the support angle 22 by plurality of fasteners 26, which are accessible with the burner in place.

Mounted on the top wall 12 of the gas/air plenum, are a plurality of air trunks of general rectangular shape with exit means in the form of air knives. The trunks may be tubular, as design criteria dictates. There is first provided a tranverse set of trunks 30, 30' that extend along the longest dimension of the plenum and consists essentially of side walls 31, 31', top wall 32 and bottom wall 33. At the juncture of the bottom wall 33 and the side wall 31 an opening is provided by an extension of the side wall 31 as at 31*a* which lies spaced from a right angular bend of the bottom wall 33, as at 33*a*. This forms an exit passageway designated 34 which may be on the order of less than 0.1 inch (0.25 cm) width which creates an air knife. An inlet to the trunk for air is designated 36 which inlet may be suitably baffled by means known to those skilled in the art.

The air trunk 30' is of identical construction as the trunk 30 just described. Also it should be noted that in effect the trunks are secured to the top wall 12 by lips 37, that are, in effect, an extension of the bottom wall 33 and extending through the lips 37 into the top wall 12, are suitable fasteners 38.

Figure 4:
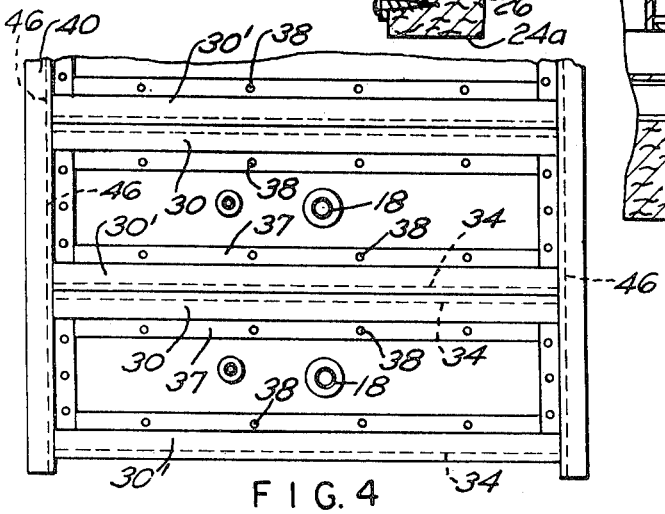
FIG. 4 is a partial plane view of the burner of our invention in a multiple burner assembly.

The edges of the plenum are fitted with longitudinal trunks 40, 40', which are made up of top side and bottom walls and 41, 42, 42' and 43. There is provided an inlet through the top wall as at 45 and an exit passage 46, forming the air knife structure, through the bottom wall at the junction of the side wall 42' and the bottom wall 43 which is, as in the other trunk, an extension of the side wall 42' and the bottom wall 43 which is, as in the other trunk, an extension of the side wall 42', as at 47, and a right angular bend extension of the bottom wall 43 as at 48. In this particular case the trunk extends laterally outward of the plenum, the reason being that the burners are adapted to be mounted in multiple, as seen in FIG. 4, so that the transverse trunks 30 will abut a similar transverse trunk 30' on an adjacent burner. The longitudinal trunks 40, 40' need not be installed as discrete sections each terminating at a point lying on an extended line passing through the abutment of transverse trunks 30, 30' as shown in FIG. 4. Rather, trunks 40, 40' may extend from the lowest heat transfer device to above the highest, thus simultaneously providing a continuous air knife for the edges of the entire assembly of heat transfer devices and acting as a structural support for the entire unitized assembly.

Figure 5:
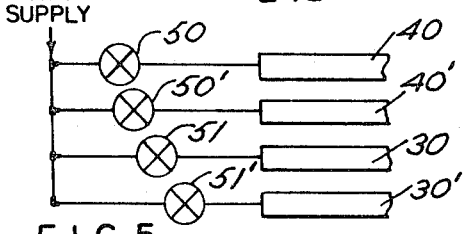
FIG. 5 is a diagramatic view of a suitable air supply system.

It will be understood that the passageways formed by the exits from the trunks through the knife structures described above, extend totally around the perimeter of the matrix. Each of the trunks is fed from an air supply and due to the fact that there are separate trunks, the volume of the air supplied to each trunk may be varied to produce unique results. For example, as shown in FIG. 5, valves 50, 50', 51, 51' may control the air flow to trunks 40, 40', 30, 30' respectively. Not only does the air escaping through the passageways confine the burning gases to the matrix itself but in addition by varying the supply of air desirable convective heating and mass transfer of water or solvent vapors may be achieved. For example, the transverse air trunks 30, 30', which abut adjacent transverse air trunks, (see FIG. 4) may be provided with sufficient air volume so that the air is escaping at a rather high velocity which means that above the treatment area (i.e., below the firing surfaces of the matrices) there will be a pressure created which is relatively lower than that created beneath the longitudinal trunks 40, 40'. Conversely, the longitudinal air trunks 40, 40' emit lower velocity air from their knife passageways which creates a higher pressure relative to that pressure existing beneath the transverse air trunks 30, 30'. In effect what this achieves is to dilute and draw the heated gases downwardly on to the web or other target so that they will impinge thereon at a pressure uniform in the transverse direction and yet may be readily exhausted at the desired transverse location. The overall result of this containment effect provides temperature diminution through dilution of hot gases with air knife emissions, mass transfer through scrubbing action of turbulent air stream, and directional flow control.

We claim:

1. A heat transfer device comprising a convective radiant burner having a gas permeable matrix, a combustible gas plenum chamber having top, side, and end walls with an open bottom, the side and end walls having abutment means, said matrix received in the open bottom and seated against said abutment, a plurality of air knife structures abutting and extending along the outer surface of the side and end walls, means for feeding each air knife structure with air independently of the others to be able to establish in each air knife independent exit velocities, each air knife structure forming a narrow elongated air discharge slot.

2. A heat transfer device as in claim 1 wherein said air knife structures include duct means seated on the top wall of said plenum.

3. A heat transfer device as in claim 1 wherein said matrix is secured to the plenum by fasteners extending through the side and end walls of the plenum and engaging the matrix, the ends of the fasteners lying at the bottom edge of said plenum walls.

4. A heat transfer device as in claim 2 wherein said duct means forms a structural support for the knives, plenums and matrices.

* * * * *